US010982568B2

(12) United States Patent
Miller et al.

(10) Patent No.: US 10,982,568 B2
(45) Date of Patent: Apr. 20, 2021

(54) PUMPING APPARATUS

(71) Applicant: Spirax-Sarco Limited, Cheltenham (GB)

(72) Inventors: Jeremy Miller, Cheltenham (GB); Obadah Zaher, Cheltenham (GB)

(73) Assignee: Spirax-Sarco Limited, Cheltenham (GB)

( * ) Notice: Subject to any disclaimer, the term of this patent is extended or adjusted under 35 U.S.C. 154(b) by 144 days.

(21) Appl. No.: 16/097,438

(22) PCT Filed: Apr. 29, 2016

(86) PCT No.: PCT/GB2016/051237
§ 371 (c)(1),
(2) Date: Oct. 29, 2018

(87) PCT Pub. No.: WO2017/187112
PCT Pub. Date: Nov. 2, 2017

(65) Prior Publication Data

US 2019/0153903 A1 May 23, 2019

(51) Int. Cl.
*F01K 17/06* (2006.01)
*F01K 17/04* (2006.01)
(Continued)

(52) U.S. Cl.
CPC ..... *F01K 17/06* (2013.01); *F01K 9/02* (2013.01); *F01K 13/02* (2013.01); *F01K 17/04* (2013.01); *F01K 25/00* (2013.01)

(58) Field of Classification Search
CPC ..... F01K 17/04; F01K 17/06; F01K 25/00; F01K 25/02; F01K 25/04; F01K 25/08;
(Continued)

(56) References Cited

U.S. PATENT DOCUMENTS

2010/0269503 A1* 10/2010 Lengert ..... F01K 25/02 60/645
2011/0041489 A1 2/2011 Melhus
(Continued)

FOREIGN PATENT DOCUMENTS

GB 2519321 A 4/2015
JP 2014125990 A 7/2014
(Continued)

OTHER PUBLICATIONS

Nov. 12, 2019—(JP) Office Action—App 2018-556342.
International Search Report and Written Opinion for PCT/GB2016/051237, dated Mar. 1, 2017.

*Primary Examiner* — Mark A Laurenzi
*Assistant Examiner* — Xiaoting Hu

(57) ABSTRACT

A pumping apparatus for a heat engine, includes an extraction line arranged to extract a fraction of liquid working fluid from a working circuit of a heat engine; an extraction line pump for pumping the extracted working fluid; an extraction line heat exchanger for vaporising the extracted working fluid; and a pressure-operated pump for pumping the working fluid around the working circuit, wherein the extraction line pump and the extraction line heat exchanger are arranged in series to convert the liquid working fluid to a pressurised motive gas; and wherein the pump is driven by the pressurized motive gas.

15 Claims, 2 Drawing Sheets

Figure 1:
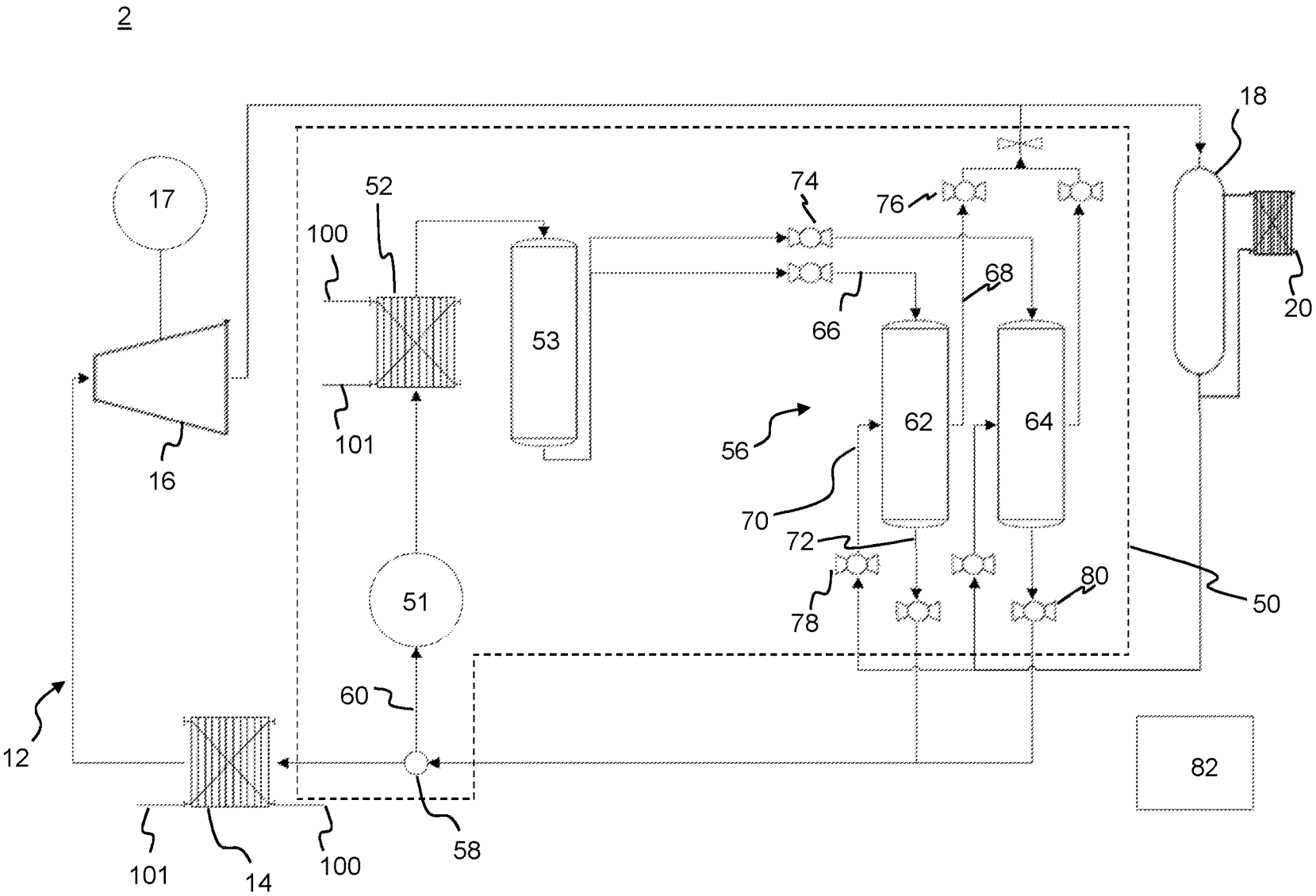

(51) Int. Cl.
*F01K 25/00* (2006.01)
*F01K 13/02* (2006.01)
*F01K 9/02* (2006.01)

(58) Field of Classification Search
CPC ... F01K 3/06; F01K 7/34; F01K 13/00; F01K 13/006; F01K 13/02; F01K 9/02
See application file for complete search history.

(56) References Cited

U.S. PATENT DOCUMENTS

2014/0373545 A1* 12/2014 Mohan ..... F01K 7/165 60/670
2015/0354398 A1* 12/2015 Rutten ..... F03G 6/065 290/2

FOREIGN PATENT DOCUMENTS

JP 2016504521 A 2/2016
WO 2011/092705 A2 8/2011

* cited by examiner

PUMPING APPARATUS

CROSS-REFERENCE TO RELATED APPLICATION

The present application is a U.S. National Phase filing of International Application No. PCT/GB2016/051237, filed on Apr. 29, 2016, and the present application claims priority to the benefit of the above-identified application, which is incorporated by reference herein in its entirety.

The invention relates to a pumping apparatus for a heat engine.

A heat engine is used to convert thermal energy into mechanical energy. An example of a typical heat engine is a Rankine cycle, in which work is generated by the expansion of a working fluid, and in which the working fluid changes phase from liquid to gas and vice versa.

The working circuit is typically a closed system containing a fixed quantity of a working fluid. The working fluid is typically pumped around the working circuit by a mechanical pump. However, traditional mechanical pumps are subject to relatively high mechanical losses.

It is therefore desirable to provide an improved pumping apparatus for a heat engine.

According to a first aspect of the invention there is provided a pumping apparatus for a heat engine, comprising: an extraction line arranged to extract a fraction of liquid working fluid from a working circuit of a heat engine; an extraction line pump for pumping the extracted liquid working fluid; an extraction line heat exchanger for vaporising the extracted working fluid; and a pressure-operated pump for pumping the working fluid around the working circuit, wherein the extraction line pump and the extraction line heat exchanger are arranged in series to convert the liquid working fluid to a pressurised motive gas; and wherein the pressure-operated pump is driven by the pressurized motive gas.

The extraction line may be arranged to extract at least 1%, at least 2%, at least 5%, at least 10%, or at least 15% of the working fluid by flow rate (for example, by volume flow rate). The extraction line may be arranged to extract less than 1%, less than 2%, less than 5%, less than 10% or less than 15% of the working fluid by flow rate. The extraction line may be arranged to extract between 1% and 20%, between 2% and 18%, between 5% and 15%, or between 8% and 12% of the working fluid by flow rate.

The extraction line pump may be disposed upstream of the extraction line heat exchanger.

The pressure-operated pump may comprise at least first and second vessels arranged to pump liquid working fluid under the action of the motive gas, and each vessel may comprise a liquid inlet and a liquid outlet for receiving and discharging liquid working fluid respectively, a gas inlet for receiving the pressurised motive gas, and a gas outlet for discharging exhaust gas from the vessel. The liquid inlet and liquid outlet may be provided as a single liquid port, with corresponding inlet and outlet valves provided in inlet lines and outlet lines coupled to the liquid port. Similarly, the gas inlet and gas outlet may be provided as a single gas port, with corresponding inlet and outlet valves provided in inlet lines and outlet lines coupled to the gas port.

The pumping apparatus may further comprise a controller configured to selectively open and close valves for the inlets and outlets of each vessel to alternate between operating the first vessel in a filling mode, in which the vessel receives liquid working fluid from the gas inlet and discharges exhaust gas from the gas outlet; and a pumping mode, in which the vessel receives pressurised motive gas from the gas inlet and discharges liquid working fluid under pressure through the liquid outlet. The controller may be configured to operate the second vessel in the filling mode when the first vessel is in the pumping mode, and to operate the second vessel in the pumping mode when the first vessel is in the filling mode. The controller may be configured so that at least one of the vessels operates in the pumping mode at all times (during operation of the heat engine).

According to a second aspect of the invention there is provided a heat engine comprising: a working circuit arranged to transfer thermal energy from a heat source to a working fluid flowing around the circuit, and to convert thermal energy to mechanical energy; and a pumping apparatus according to the first aspect of the invention for pumping the working fluid around the working circuit.

The working circuit may comprise, in order with respect to the direction of motion of the working fluid: a main heat exchanger for transferring heat from the heat source to the working fluid; an expander for converting thermal energy in the working fluid to mechanical energy; a condenser for condensing a vapour phase of the working fluid; and the pressure-operated pump of the pumping apparatus.

The extraction line of the pumping apparatus may be arranged to extract working fluid from between the main heat exchanger of the working circuit and the expander. The main heat exchanger may be configured so that the working fluid is liquid when exiting the main heat exchanger. The working fluid may have a dryness of 0% when exiting the main heat exchanger. The expander may be configured so that at least part of the working fluid exiting the expander is liquid, for example, sub-cooled liquid, 0% dry saturated liquid, or two-phase flow comprising a liquid phase and a gas phase. The expander may be a two-phase expander.

The heat engine may further comprise a phase separator disposed between the expander and the condenser of the working circuit for separating the working fluid into liquid and gas streams, and the working circuit may be arranged so that the liquid stream bypasses the condenser. The phase separator may be in fluid communication with the pressure-operated pump so that the phase separator provides liquid working fluid to the pressure-operated pump and receives exhaust gas from the pressure-operated pump.

The working fluid may have a boiling point lower than the water-steam boiling point, so that the heat engine is an Organic Rankine Cycle. It will be appreciated that the boiling point of the working fluid may be less than the water-steam boiling point under the same pressure conditions.

According to a third aspect of the invention there is provided a method of operating a heat engine comprising: a working circuit configured to transfer thermal energy to a working fluid and to convert thermal energy to mechanical energy; and a pumping apparatus for pumping the working fluid around the working circuit; the method comprising: extracting a fraction of liquid working fluid from the working circuit; pumping the extracted liquid working fluid and vaporising the extracted working fluid to provide a pressurised motive gas; and providing the pressurised motive gas to a pressure-operated pump of the pumping apparatus to pump the working fluid around the working circuit.

The pressure-operated pump may be a positive displacement pump.

The method may comprise the steps of operating a pressure operated pump in accordance with the first aspect of the invention and/or operating a heat engine in accordance with the second aspect of the invention.

In other aspects, the pumping apparatus may have an extraction line arranged to extract a fraction of gaseous working fluid and/or liquid working fluid from a working circuit of a heat engine.

In particular, according to a fourth aspect there is provided a pumping apparatus for a heat engine, comprising: an extraction line arranged to extract a fraction of working fluid from a working circuit of a heat engine; a propulsion device configured to pressurise the extracted working fluid to provide a pressurised motive gas; and a pressure-operated pump for pumping the working fluid around the working circuit, wherein the pressure-operated pump is driven by the pressurized motive gas. The propulsion device may pressurise the extracted working fluid.

The propulsion device may be a compressor for compressing the extracted working fluid. For example, the working fluid may be extracted in gaseous form and may be compressed by the compressor. The compressor may be a mechanical compressor, for example, comprising at least one rotor, or a plurality of rotors and stators.

Alternatively, the extraction line may be configured to extract a liquid working fluid; and the pumping apparatus may further comprise an extraction line heat exchanger for vaporising the extracted liquid working fluid. The propulsion device, for example a compressor, may be arranged downstream of and separate from the extraction line heat exchanger.

Alternatively, the propulsion device may be arranged upstream of the extraction line heat exchanger. For example, the propulsion device may be a liquid pump and the pumping apparatus may be in accordance with the first aspect of the invention.

A pumping apparatus or heat engine according to the fourth aspect of the invention may have any combination of the features of the pumping apparatus of the first aspect of the invention, except such combinations as are mutually exclusive. For example, a pumping apparatus in accordance with the fourth aspect of the invention may be configured to extract gaseous working fluid (rather than a liquid working fluid), and may have a pressure-operated pump with any of the features defined with respect to the first aspect of the invention.

The main heat exchanger may have a metallic heat exchange component. For example, the heat exchanger may be a shell and tube heat exchanger having metallic tubes.

The pressure-operated pump may have a vessel having a capacity of between 0.1 $m^3$ and 100 $m^3$.

According to a fifth aspect of the invention there is provided a method of operating a heat engine comprising: a working circuit configured to transfer thermal energy to a working fluid and to convert thermal energy to mechanical energy; and a pumping apparatus for pumping the working fluid around the working circuit; the method comprising: extracting a fraction of the working fluid from the working circuit; propelling the extracted working fluid to provide a pressurised motive gas; and providing the pressurised motive gas to a pressure-operated pump of the pumping apparatus to pump the working fluid around the working circuit.

Propelling the extracted working fluid may comprise compressing the extracted working fluid.

The fraction of working fluid may be extracted from a portion of the working circuit in which the working fluid is liquid. The method may comprise vaporising the extracted liquid working fluid prior to propelling, for example, with a compressor.

Alternatively, the method may comprise pumping the extracted liquid working fluid, for example with a liquid pump, and vaporising the extracted liquid fluid, for example with a heat exchanger, as per the third aspect of the invention. The heat exchanger may be downstream of the liquid pump.

The invention will now be described, by way of example, with reference to the accompanying drawings, in which:

FIG. 1 schematically shows an example heat engine; and

Figure 2:
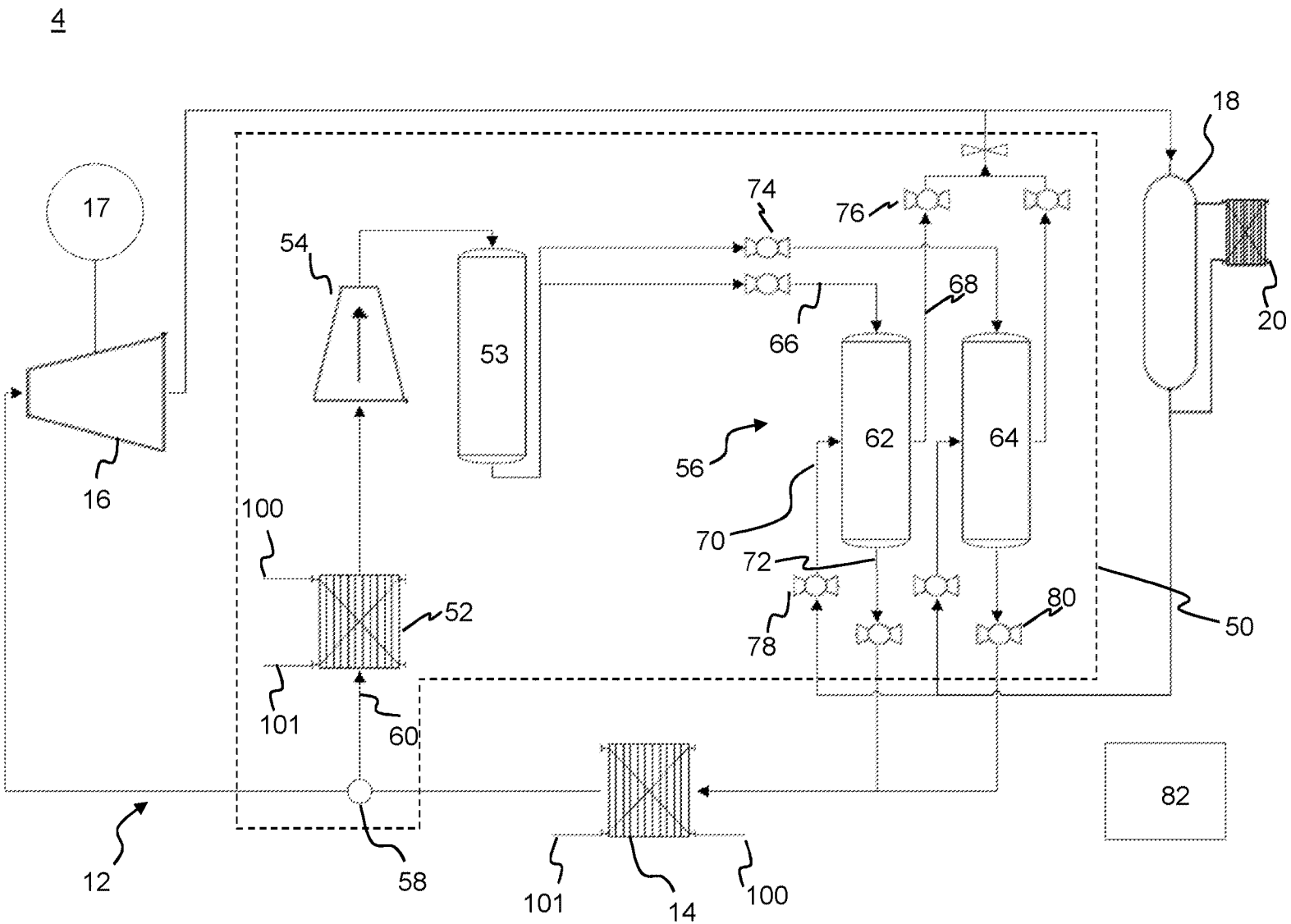

FIG. 2 schematically shows a further example heat engine.

FIG. 1 shows an example heat engine 2 for converting thermal energy from a heat source to mechanical energy. In this example, the heat source is a condensate flow 100 from a steam system. The heat engine 2 comprises a working circuit 12 having, in order with respect to the transport of the working fluid around the circuit 12, a main heat exchanger 14, an expander 16, a phase separator 18, a condenser 20 and a pressure-operated pump 56. A working fluid flows around the working circuit 12.

The heat engine 2 also comprises a pumping apparatus 50 for pumping the working fluid around the working circuit. The pumping apparatus 50 comprises an extraction line pump 51, an extraction line heat exchanger 52 (or secondary heat exchanger), a buffer tank 53, and the pressure-operated pump 56 (which forms part of the working circuit 12).

A heat source side of the main heat exchanger 14 is arranged to receive the condensate flow 100 so that working fluid in a heat sink side of the main heat exchanger 14 is heated. The main heat exchanger 14 is fluidically coupled to the expander 16 by a fluid line so that the heated working fluid flows to the expander 16 and is expanded to a lower pressure. A generator 17 is coupled to the expander 16 for generating electrical energy from the expander 16.

The output of the expander 16 is fluidically coupled to the phase separator 18 by a fluid line. The phase separator 18 is configured to separate liquid and gas phases of the expanded working fluid into separate streams. In this embodiment, the phase separator 18 is a simple gravity-based separation vessel as is known in the art. In alternative embodiments, the phase separator may be a centrifugal separator such as a hydrocyclone. The phase separator 18 comprises a surge tank or buffer tank that can store both liquid working fluid and gaseous working fluid, so that either one may be drawn upon when the working circuit is temporarily operating in a non-equilibrium state (i.e. owing to a change in the rate of heat input at the main heat exchanger 14).

The phase separator 18 is fluidically coupled to the condenser 20 by a fluid line so that the gas phase stream of the expanded working fluid is condensed downstream of the phase separator. The condenser 20 comprises a heat source side which receives the gas phase stream of the working fluid, and a heat sink side which receives a cooling fluid, such as cool liquid water.

Fluid lines extending downstream from the condenser 20 and phase separator 18 join so that condensed (liquid) working fluid from the condenser 20 joins with the liquid working fluid from the phase separator 18.

The fluid line carrying the liquid working fluid from the condenser 20 and the phase separator 18 is coupled to the pressure operated pump 56, which is arranged to pump the liquid working fluid around the working circuit 12, as will be described in detail below.

The pumping apparatus 50 comprises an extraction valve 58 disposed in a fluid line of the working circuit 12 and configured to extract a portion of working fluid from the working circuit 12. In this particular example, the extraction valve 58 is disposed in the fluid line extending between the pressure operated pump 50 and the main heat exchanger 14. An extraction line 60 is coupled to the extraction valve 58 so that a fraction of the working fluid can be extracted from the working circuit 12 into the extraction line 60.

In this example, the extraction line 60 is configured to convey extracted liquid working fluid first through the extraction line pump 51 and secondly through the extraction line heat exchanger 52 (i.e. in series). The extraction line 60 is fluidically coupled to the extraction line pump 51, which is configured to propel and thereby pressurise the extracted working fluid through a fluid line to the extraction line heat exchanger 52. The extraction line heat exchanger 52 is configured to receive hot condensate flow 100 on a heat source side and to receive the extracted working fluid from the pump 51 on a heat sink side. The extraction line heat exchanger 52 is separate from the pump 51 and configured to vaporise the working fluid by evaporation to provide a pressurised motive gas (i.e. at higher pressure relative to the working fluid between the main heat exchanger 14 and the expander 16).

In this particular example, there is a buffer tank 53 between the extraction line heat exchanger 52 and the pressure-operated pump 56, so that there is a ready supply of pressurised motive gas, which may be drawn upon, for example, if a controller for the heat engine initiates an increase in the flow rate of the working fluid.

The pressure-operated pump 56 is arranged to receive the pressurised motive gas and to drive the liquid working fluid received therein from the phase separator 18 and condenser 20 around the working circuit 12. The pressure-operated pump 56 comprises first and second pumping vessels 62, 64, each having a gas inlet 66, gas outlet 68, liquid inlet 70 and liquid outlet 72 provided with respective control valves 74, 76, 78, 80. The gas inlet 66 and gas outlet 68 may be co-located, for example in a single gas port. Control valves 74, 76 for the gas inlet 66 and gas outlet 68 may be provided in the fluid lines leading to the inlet 66 or outlet 68 respectively, or the common port. Similarly, the liquid inlet 70 and liquid outlet 72 may be co-located, for example in a single liquid port. Control valves 78, 80 for the liquid inlet 70 and liquid outlet 72 may be provided in the fluid lines leading to the inlet 70 or outlet 72 respectively, or the common port.

The pressure-operated pump 56 has a controller 82 configured to control the valves for the respective inlets and outlets so that each of the first and second pumping vessels 62, 64 can be operated in either a filling mode or a pumping mode. In the filling mode, the respective vessel is arranged to receive and store liquid working fluid from the phase separator 18 and condenser 20, and so the valves 76, 78 for the gas outlet 68 and the liquid inlet 70 respectively are open, whereas the valves 74, 80 for the gas inlet 66 and the liquid outlet 72 respectively are closed. In the pumping mode, the respective vessel is arranged to pump out liquid working fluid stored therein under the action of the pressurised motive gas received from the liquid pump 51 and extraction line heat exchanger 52 via the buffer tank 53, and so the valves 74, 80 for the gas inlet 66 and the liquid outlet 72 respectively are open, whereas the valves 76, 78 for the gas outlet 68 and the liquid inlet 70 respectively are closed.

In order to constantly pump working fluid around the working circuit during operation, the controller 82 is configured so that during operation of the heat engine at least one (in this example, only one) of the first and second pumping vessels 62, 64 is in the pumping mode at any one time (during operation), whereas the other vessel 62, 64 operates in the filling mode. The first and second vessels 62, 64 are therefore configured to be alternately operated in the pumping and filling modes respectively.

During filling, gas is displaced from the respective vessel 62, 64 as liquid working fluid is received therein. The gas is exhausted via the gas outlet 68, which is in fluid communication with the phase separator 18 by a fluid line. Accordingly, the gas received at the phase separator 18 from the vessels 62, 64 mixes with the gas stream of working fluid from the expander 16, and is subsequently condensed in the condenser 20, before flowing back to the pressure-operated pump 56 as liquid working fluid, thereby rejoining the working circuit 12. In other embodiments, the gas may be exhausted from the gas outlet 68 directly to the condenser 20.

A controller for the heat engine is provided for controlling the operation of the heat engine. In particular, the controller may monitor the temperature of at least the condensate flow 100, and the temperature, pressure and dryness fraction of the working fluid at various locations around the working circuit. The controller may control the operation of various parts of the system to ensure it continues to operate as desired. For example, the controller may increase the flow rate of the pressure-operated pump 56 in response to an increase in the temperature or mass flow rate of the condensate flow 100. In this example, the controller 82 for the pressure-operated pump also comprises the controller for the heat engine, but in other examples the controller for the heat engine may be linked to the controller 82 for the pressure operated pump 56. The controller 82 may also be configured to adjust the fraction of working fluid extracted by the extraction valve 58, and/or or the compression ratio of the liquid pump 51, in order to adjust the flow rate of the working fluid. The controller 82 may also monitor the levels of liquid phase and gas phase working fluid stored in the various buffer tanks, and adjust various parameters of the system accordingly. For example, if more liquid working fluid is required, the controller may increase the flow rate of the cooling liquid in the condenser, or reduce the mass flow rate of the condensate flow 100, so as to reduce the temperature of the working fluid in the working circuit as a whole. The controller may also be configured to control the mass flow rate of the condensate flow 100. For example, this may be reduced if the controller determines that the working fluid is being evaporated in the main heat exchanger 14.

An example method of operating the heat engine 2 will now be described. In this example, the heat engine is configured so that the working fluid remains in the liquid phase between the main heat exchanger 14 and the expander 16. Consequently, the expander 16 is a two-phase expander, such as a screw-type expander, configured so that part of the flow of working fluid exiting the expander 16 is a multi-phase flow. This type of heat engine can be referred to as a tri-lateral flash cycle.

In this example, the working fluid is tetrafluoroethane (otherwise known as 1,1,1,2-Tetrafluoroethane or R-134a, or under a number of product names such as Genetron 134a), which is an inert gas refrigerant.

The heat source is a condensate flow 100 of liquid water from a steam system having a temperature of 80° C. which is received in the heat source side of the main heat exchanger 14 at a flow rate of 7.2 kg/s. The cooling fluid is liquid water at 15° C., received in the heat sink side of the condenser 20 at a flow rate of 68.8 kg/s.

Between the pressure operated pump 50 and the main heat exchanger 14, the working fluid is in the liquid phase (which may be sub-cooled liquid or 0% dryness fraction liquid at saturation temperature) at 21.89 bar pressure (gauge) and 21.9° C.

As described above, in this example the extraction valve 58 is disposed between the pressure-operated pump 50 and the main heat exchanger 14, and is configured to extract a fraction of the liquid working fluid.

In this example, a main portion of the working fluid flows past the extraction valve 58 along the fluid line between the pressure-operated pump 50 and the main heat exchanger 14 and the two-phase expander 16 (approximately 90% by mass), whereas the extraction valve 58 extracts a minor portion (approximately 10% by mass) of the working fluid from the fluid line and diverts the extracted fluid along the extraction line 60 to the extraction line pump 51. This extracted portion is no longer considered to be part of the working circuit, as it does not flow through the expander 16, and so does not generate mechanical work/energy. In this particular example, the total mass flow rate in the working circuit prior to extraction of the minor portion is 13.35 kg/s, whereas the mass flow rate of the extracted portion is 1.32 kg/s.

The extraction line pump 51 pressurises the extracted liquid working fluid to a pressure of 23.59 bar, and propels it towards the downstream extraction line heat exchanger 52.

The extraction line pump 51 is of any suitable type for pumping liquid (i.e. a liquid pump). For example, the extraction line pump 51 may be a centrifugal, piston, vane or scroll pump. In this particular example, the extraction line pump 51 has a magnetically-driven rotor disposed within a sealed housing having ports for receiving and discharging the extracted working fluid. Accordingly, the housing has no ports or openings for receiving a rotary shaft, and no lubrication of the rotor is required. In this example the shaft power for operating the extraction line pump is 0.8213 kW.

The extraction line heat exchanger 52 receives the hot condensate flow 100 in a heat source side of the heat exchanger 52 and receives the extracted working fluid from the extraction line pump 51 in a heat sink side, so that heat is transferred from the condensate flow 100 to the extracted working fluid to heat and vaporise the extracted working fluid by evaporation. Consequently, the extracted fluid exits the extraction line heat exchanger 52 as a pressurised motive gas (e.g. at 100% dryness fraction). In this example, the temperature of the extracted working fluid is increased from 21.9° C. to 71.5° C. as it passes through the extraction line heat exchanger, and there is a minor drop in pressure to 23.49 bar.

The pressurised motive gas flows to the pumping vessels 62, 64 in the manner described above to drive the working fluid around the working circuit 12.

Referring back to the main working circuit 12, as the main portion of the working fluid flows through the main heat exchanger 14, its temperature increases to 76.5° C. The working fluid remains in the liquid phase. Correspondingly, the temperature of the condensate flow 100 reduces from 80° C. to 28.9° C. as it flows through the main heat exchanger 14, and to a drain 101. In other embodiments, the working fluid may be heated so that it is two-phase after the main heat exchanger 14, such as 20% dryness fraction saturated fluid (80% saturated liquid, 20% saturated vapour).

The main portion of the working fluid continues to flow along the working circuit 12 from the main heat exchanger 14 to the two-phase expander 16. As the fluid flows through the two-phase expander 16, the pressure reduces to 6.77 bar and the temperature reduces to 25.6° C. The expander 16 extracts approximately 61.1 kW of mechanical power as the working fluid expands. The working fluid exiting the expander comprises both liquid and gas phases (approximately 42% dryness fraction), and enters the phase separator 18 for separation into separate liquid and gas streams.

The gas phase of the working fluid flows through the heat source side of the condenser 20, where it condenses and cools slightly. Correspondingly, the temperature of the cooling water increases (in this example, from 15° C. to 20.6° C.).

The two streams of liquid working fluid from the phase separator 18 and condenser 20 combine upstream of the pressure-operated pump 56 at a pressure of 6.43 bar and a temperature of 20.9° C.

The pressure-operated pump 56 receives high temperature (71.5° C.) pressurised motive gas at a pressure of 23.49 bar, which is selectively alternately distributed by the controller 80 to the pump vessels 62, 64 to pressurise and pump the liquid working fluid received therein from the phase separator 18 and condenser 20. The temperature of the working fluid also increases to 21.9° C. as it is pressurised and owing to contact with the relatively high temperature pressurised motive gas.

The pressurised liquid working fluid leaves the pressure-operated pump 56 at a pressure of 21.89 bar and a temperature of 21.9° C., and flows to the main heat exchanger 14.

The thermal cycle of the working circuit 12 repeats as outlined above. The thermal cycle is controlled by the controller for the heat engine 2. For example, the controller may regulate the mass flow rates of the condensate flow 100, the cooling fluid 102 and the working fluid as discussed above, dependent on the temperature, pressure and dryness fraction of the working fluid at different parts of the heat engine.

The applicant has calculated that the extraction of a fraction of the working fluid (approximately 20%), and its subsequent pressurisation and vaporisation for use as a pressurised motive gas in the pressure-operated pump 56 results in significant efficiency savings when compared to the use of a mechanical pump for the liquid working fluid.

In particular, based on the example above the applicant has calculated a power output of approximately 55 kW from the two-phase expander 16, and requires a power input of approximately 0.4 kW to drive the extraction line pump 51 of the pump apparatus 50. Accordingly, there is a net power recovery of approximately 54.6 kW.

By way of comparison, the applicant has calculated that a modified system using a conventional mechanical pump for pumping the liquid working fluid around the working circuit 12 would result in a power output of approximately 64 kW (marginally higher than above, since 100% of the working fluid is used in the working circuit), but requires a significantly higher power input of approximately 37 kW (based on pump manufacturer data).

Accordingly, it can be seen that extracting, pressurising and vaporising a portion of the working fluid to drive the working fluid around the working circuit using a pressure-operated pump results in a significantly higher overall power output (i.e. taking into account the power input required). Since working circuits are closed systems, the use of a pressure-operated pump has not previously been considered as such pumps require the provision of a high pressure motive gas. However, the above described examples generate a high pressure motive gas from the working fluid itself, which eventually condenses and rejoins the main working fluid. Accordingly, there is no net addition or reduction of working fluid in the working circuit over time (i.e. it remains a closed system).

These efficiency savings are in part a result of the relatively low power required to pressurise the working fluid, when compared with the relatively high power required to pump the dense liquid fluid around the working circuit. In a conventional heat engine having a two-phase expander, the only part of the heat engine in which the working fluid is (even partly) vaporised is in the low pressure region downstream of the expander. However, owing to the low pressure of this fluid, it would not be feasible to compress this portion of the fluid for use in a pressure-operated pump.

Further, the applicant has found that liquid pumps for use in the extraction line 60 do not require addition of a lubricant to working fluid, nor an independent lubricant supply (e.g. lubricating oil) in use. In this particular example, the working fluid comprises approximately 1% lubricant by weight, which is provided at this level for the purposes of maintaining the expander 16, rather than for lubricating the liquid pump.

In this particular example, the liquid pump is a sealed pump having a magnetically-driven rotor and an external driver coupled to a motor, and which is not exposed to the working fluid within the pump.

FIG. 2 schematically shows a further example of a heat exchanger 4 which differs from the heat exchanger 2 described above in that the extraction line 60 conveys the extracted working fluid to an extraction line heat exchanger 52 and a compressor 54 (in series order) in place of the extraction line pump 51 and the extraction line heat exchanger 52 described above. Further, the extraction line 60 extends from an extraction valve 58 disposed between the main heat exchanger 14 and the expander 16.

In use, liquid working fluid is extracted at the extraction valve 58 between the main heat exchanger 14 and the expander 16, and is conveyed by the extraction line 60 to the extraction line heat exchanger 52. Accordingly, in this example the extracted working fluid is at a temperature of 71.5° C. and a pressure of 21.89 bar. In this example, 1.32 kg/s of working fluid is extracted from a total of 13.35 kg/s in the working circuit.

The extraction line heat exchanger 52 operates in the same manner as described above to vaporise the extracted liquid working fluid. In this example, the heat input to the extracted working fluid causes a change in state from liquid to gas, without a temperature rise (i.e. phase change from liquid refrigerant to saturated gaseous refrigerant), so that the heat exchanger 52 outputs dry saturated working fluid at 71.5° C. The extraction line heat exchanger 52 is coupled to the compressor 54 by a fluid line, wherein the vaporised fluid is compressed so as to provide a pressurised motive gas (i.e. at higher pressure relative to the working fluid between the main heat exchanger 14 and the expander 16).

In this example, the compressor operates to compress and thereby superheat the vaporised fluid to provide a superheated pressurised motive gas at 23.39 bar and 76.13° C.

The pressurised motive gas is provided to the buffer tank 53, as described above, in order to provide a ready supply for the pressure operated pump 56.

Based on the example described above, the applicant has calculated a power output of approximately 55 kW from the two-phase expander 16, and requires a power input of approximately 1.6 kW to drive the compressor 54 of the pump apparatus 50. Accordingly, there is a net power recovery of approximately 53.4 kW.

In this example, the compressor is operated to superheat the vaporised extracted working fluid. This may have operational advantages as condensation of the working fluid in the fluid lines between the compressor 54 and the pressure operated pump 50 may be avoided, provided that any cooling along the respective fluid lines is less than the amount of superheat. Superheated fluids typically have a lower thermal conductivity, and thereby thermal losses may be minimised. In addition, adverse flow effects such as water hammer may be avoided by using a superheated working fluid.

The energy required to compress and superheat the gaseous working fluid may contribute to the difference in the power input to the compressor 54, as compared with the power input to the liquid pump 51 of the first example.

The applicant has found that a compressor for compressing and propelling a gaseous working fluid may require a relatively high level of lubricant (for example, as compared with a liquid pump). In this particular example, the applicant has found that a lubricant, such as oil, may become suspended in the gaseous working fluid within the compressor, and may collect within the downstream buffer tank 53. Accordingly, in this example the working fluid has a relatively high proportion of lubricant, such as 5% by weight, in order that sufficient lubricant is provided to the compressor. An example compressor is a reciprocating piston compressor. Such compressors may be provided with a lubricant supply in an integrated sump. It will be appreciated that such compressors, as are known in the art, may be deployed in fluid circuits (such as for heating or refrigeration) that operate on a relatively low volume of working fluid, and therefore the absolute amount of lubricant required may be correspondingly low (i.e. it may scale with the total quantity of working fluid in the fluid circuit). In the example described herein, whilst the compressor is provided in the extraction line 60 to compress a relatively small proportion (the extracted portion) of the total working fluid, the extracted portion of the working fluid ultimately re-joins the main flow of working fluid. Accordingly, a relatively larger absolute quantity of lubricant may be required, and may scale with the total quantity of working fluid in both the extraction line 60 and main flow path of the working circuit 12. In other examples, an oil separator (such as an oil sump separator) may be provided within, or in fluid communication with, the buffer tank 53 for collecting oil from the working fluid, and the oil separator may be in fluid communication with a replenishment reservoir or integrated sump for the compressor.

In further examples, the working fluid between the main heat exchanger and the expander may be two-phase. For example, an extraction line heat exchanger may be provided for vaporising the liquid phase component of the extracted working fluid, prior to pressurising the extracted working fluid (for example, using a compressor).

In a further example, the heat engine may be configured so that the working fluid vaporises by evaporation as it passes through the main heat exchanger 14, for example, an Organic Rankine Cycle (ORC) heat engine. In such embodiments, the pump apparatus 50 would extract the vaporised working fluid from between the main heat exchanger 14 and the expander 16, and there would be no need for an extraction line heat exchanger 52 for vaporising the extracted working fluid. Accordingly, in such examples, there may be no extraction line heat exchanger 52. For example, the extraction line 60 may convey extracted working fluid directly from the extraction valve 58 to a compressor 54. However, it may be desirable to provide an extraction line heat exchanger 52, for example, to eliminate any wetness from the working fluid by heating (i.e. so that the working fluid has a dryness fraction of 100%).

In an ORC heat engine, the expander 16 would be a conventional expander configured to operate on dry vapour, such as a turbine. Consequently, the working fluid exiting the expander would also be dry, and there would be no requirement for a phase separator between the expander and the condenser. Similarly, gas from the pumping vessels would be exhausted directly to the condenser.

An example of a suitable working fluid for ORC is pentafluoropropane (also known as HFC-245fa, or 1,1,1,3,3,-Pentafluoropropane).

In each of the above examples, there is a propulsion device 51, 54 in the extraction line (i.e. positioned to receive extracted working fluid from the extraction line) upstream of the pressure-operated pump, for pressurising the working fluid. For example, the propulsion device may be an extraction line pump for pumping extracted liquid working fluid, or may be a compressor for compressing gaseous extracted working fluid (which may be extracted in gaseous form or vaporised after extraction by an extraction line heat exchanger).

The invention claimed is:

1. A heat engine comprising:

a working circuit arranged to transfer thermal energy from a heat source to a working fluid flowing around the circuit, and to convert thermal energy to mechanical energy; and a pumping apparatus comprising:

an extraction line arranged to extract a fraction of the working fluid from the working circuit, wherein the fraction of the working fluid is extracted in a liquid state;

a propulsion device for propelling an extracted working fluid comprising the fraction of the working fluid extracted from the working circuit;

an extraction line heat exchanger for vaporising the extracted working fluid; and a pressure-operated pump for pumping the working fluid around the working circuit;

wherein the propulsion device and the extraction line heat exchanger are arranged in series to convert the extracted working fluid to a pressurised motive gas, wherein the pressure-operated pump is driven by the pressurised motive gas;

wherein the working circuit comprises, in order with respect to a direction of motion of the working fluid:

a main heat exchanger for transferring heat from the heat source to the working fluid;

an expander for converting thermal energy in the working fluid to mechanical energy;

a condenser for condensing a vapour phase of the working fluid; and the pressure-operated pump of the pumping apparatus, and wherein the extraction line of the pumping apparatus is arranged to extract the fraction of the working fluid from between the main heat exchanger of the working circuit and the expander.

2. The heat engine according to claim 1, wherein the main heat exchanger is configured so that the working fluid is liquid when exiting the main heat exchanger.

3. The heat engine according to claim 1, wherein the expander is configured so that at least part of the working fluid exiting the expander is liquid.

4. The heat engine according to claim 1, wherein the expander is a two-phase expander.

5. The heat engine according to claim 1, further comprising a phase separator disposed between the expander and the condenser of the working circuit for separating the working fluid into liquid and gas streams, wherein the working circuit is arranged so that the liquid stream bypasses the condenser.

6. The heat engine according to claim 5, wherein the phase separator is in fluid communication with the pressure-operated pump so that the phase separator provides the working fluid to the pressure-operated pump and receives exhaust gas from the pressure-operated pump.

7. The heat engine according to claim 1, wherein the working fluid has a boiling point lower than a water-steam boiling point, so that the heat engine is an Organic Rankine Cycle.

8. The heat engine according to claim 1, wherein the propulsion device is an extraction line pump that is disposed upstream of the extraction line heat exchanger.

9. The heat engine according to claim 1, wherein the pressure-operated pump comprises at least first and second vessels arranged to pump the working fluid under action of the motive gas, each of the first and second vessels comprising a liquid inlet and a liquid outlet for receiving and discharging the working fluid respectively, a gas inlet for receiving the pressurised motive gas, and a gas outlet for discharging exhaust gas from the respective first or second vessel.

10. The heat engine according to claim 9, further comprising a controller configured to selectively open and close valves for the liquid and gas inlets and the liquid and gas outlets of the first and second vessels to alternate between operating the first vessel in a filling mode, in which the first vessel receives the working fluid from the liquid inlet and discharges exhaust gas from the gas outlet; and a pumping mode, in which the first vessel receives pressurised motive gas from the gas inlet and discharges the working fluid under pressure through the liquid outlet.

11. The heat engine according to claim 10, wherein the controller is configured to operate the second vessel in the filling mode when the first vessel is in the pumping mode, and to operate the second vessel in the pumping mode when the first vessel is in the filling mode; and/or wherein the controller is configured so that at least one of the first and second vessels operates in the pumping mode at all times.

12. The heat engine according to claim 1, wherein the propulsion device is a compressor that is arranged downstream of the extraction line heat exchanger in series.

13. A method of operating a heat engine comprising a working circuit configured to transfer thermal energy to a working fluid and to convert thermal energy to mechanical energy, the working circuit comprising, in order with respect to a direction of motion of the working fluid:

a main heat exchanger for transferring heat from a heat source to the working fluid;

an expander for converting thermal energy in the working fluid to mechanical energy; and a condenser for condensing a vapour phase of the working fluid; and the heat engine further comprising a pumping apparatus for pumping the working fluid around the working circuit, the method comprising:

extracting a fraction of the working fluid from the working circuit between the main heat exchanger of the working circuit and the expander, wherein the fraction of the working fluid is extracted in a liquid state;

propelling an extracted working fluid comprising the fraction of the working fluid extracted from the working circuit, and vaporising the extracted working fluid to provide a pressurised motive gas; and providing the pressurised motive gas to a pressure-operated pump of the pumping apparatus to pump the working fluid around the working circuit.

14. The method according to claim 13, wherein the extracted working fluid is propelled by a compressor, and the extracted working fluid is vaporised by an extraction line heat exchanger arranged upstream from the compressor in series.

15. A heat engine comprising:

a working circuit arranged to transfer thermal energy from a heat source to a working fluid flowing around the circuit, and to convert thermal energy to mechanical energy; and a pumping apparatus comprising:

an extraction line arranged to extract a fraction of the working fluid from the working circuit, wherein the fraction of the working fluid is extracted in a liquid state;

an extraction line pump or compressor for propelling an extracted working fluid comprising the fraction of the working fluid extracted from the working circuit;

an extraction line heat exchanger for vaporising the extracted working fluid; and a pressure-operated pump for pumping the working fluid around the working circuit;

wherein the extraction line pump or compressor and the extraction line heat exchanger are arranged in series to convert the extracted working fluid to a pressurised motive gas, wherein the pressure-operated pump is driven by the pressurised motive gas;

wherein the working circuit comprises, in order with respect to a direction of motion of the working fluid:

a main heat exchanger for transferring heat from the heat source to the working fluid;

an expander for converting thermal energy in the working fluid to mechanical energy;

a condenser for condensing a vapour phase of the working fluid; and the pressure-operated pump of the pumping apparatus, and wherein the extraction line of the pumping apparatus is arranged to extract the fraction of the working fluid from between the main heat exchanger of the working circuit and the expander.

* * * * *